US005444455A

United States Patent [19]

Louzir et al.

[11] Patent Number: 5,444,455

[45] Date of Patent: Aug. 22, 1995

[54] HELICAL ANTENNA FEED ELEMENT WITH SWITCHES TO SELECT END FIRE AND BACKFIRE MODES AND CIRCULAR POLARIZATION DIRECTION

[75] Inventors: Ali Louzir, Strasbourg, France; Masahiro Fujimoto, Kawasaki, Japan

[73] Assignee: Thomson Consumer Electronics, S.A., Courbevoie, France

[21] Appl. No.: 169,892

[22] Filed: Dec. 20, 1993

[30] Foreign Application Priority Data

Dec. 22, 1992 [EP] European Pat. Off. ..... 92403535.5

[51] Int. Cl.[6] ..... H01Q 1/36

[52] U.S. Cl. ..... 343/895; 343/729; 343/837; 343/840; 343/876; 343/911 L; 343/911 R

[58] Field of Search ..... 343/837, 840, 876, 895, 343/729, 911 L, 911 R; H01Q 1/36

[56] References Cited

U.S. PATENT DOCUMENTS

| | | | |
|---|---|---|---|
| 3,019,438 | 1/1962 | Pan | 343/895 |
| 3,184,747 | 5/1965 | Kach | 343/895 |
| 3,487,413 | 12/1969 | Shores | 343/911 L X |
| 3,618,090 | 11/1971 | Garrison | 343/911 L X |
| 4,014,028 | 3/1977 | Cone et al. | 343/895 |
| 4,268,831 | 5/1981 | Valentino et al. | 343/911 L |
| 4,924,238 | 5/1990 | Ploussios | 343/895 X |
| 5,309,167 | 5/1994 | Cluniat et al. | 343/895 X |

FOREIGN PATENT DOCUMENTS

| | | | |
|---|---|---|---|
| 562302 | 8/1958 | Canada | 343/840 |
| 1626328 | 2/1971 | U.S.S.R. | 343/840 |

OTHER PUBLICATIONS

John D. Kraus, Author (The Helical Antenna–McGraw–Hill, Inc. ©1988) Section 7–4, pp. 276–289 and Section 7–15, pp. 326–329.

*Primary Examiner*—Donald Hajec
*Assistant Examiner*—Steven P. Wigmore
*Attorney, Agent, or Firm*—Joseph S. Tripoli; Eric P. Herrmann; Frederick A. Wein

[57] ABSTRACT

An antenna system capable of receiving electromagnetic radiation having either right or left helical polarization, and either vertical or horizontal linear polarization includes an energy concentrator which concentrates energy at a focal point. A helical antenna is arranged in the proximity of the focal point. A first switch switches the helical antenna to a backfire mode of operation and a second switch switches the helical antenna to an end fire mode of operation. A control mechanism controls the switches to select the nature of the polarization.

4 Claims, 3 Drawing Sheets

HELICAL ANTENNA FEED ELEMENT WITH SWITCHES TO SELECT END FIRE AND BACKFIRE MODES AND CIRCULAR POLARIZATION DIRECTION

BACKGROUND

The present invention relates to an antenna system using a helical antenna for the reception of radiofrequencies and especially for the reception of microwaves.

A helical antenna consists of a single conductor or multiple conductors wound into a helical shape. Beside some other possible modes a helical antenna is normally used in a so-called axial mode or in a normal mode. The axial mode provides maximum radiation along the helix axis, which occurs when the helix circumference is of the order of one wavelength. The normal mode which yields radiation broadside to the helix axis, occurs when the helix diameter is small with respect to a wavelength. For the application according to the present invention the axial mode is of special interest.

The use of helical antennas for such antenna systems are widely known. For example U.S. Pat. No. 3,184,747 presents a coaxial feed helical antenna which has a director disk between feed and helix producing endfire radiation towards the disk. In this U.S. Patent the dimensions of the helix for such an antenna system are given.

U.S. Pat. No. 4,742,359 presents an antenna system using a helical antenna with two ends where the first end is linked to a feeder line. For the purpose of the following explanation it is understood that the said feeder line is aligned with the axis of the said helical antenna. Such a helical antenna may be built as a so-called endfire helical antenna, where under maximum received power conditions the direction of the signal power flow at the said first end is in the same direction as the received radiation. Such a helical antenna can also be built as a so-called backfire helical antenna, where under maximum received power conditions the direction of the signal power flow at the said first end is in the opposite direction to the received radiation.

In said U.S. patent an antenna system is presented, which comprises a reflector, a primary helical antenna having a coil with a pair of ends, said coil located at the focal point of said reflector so that the axis of the helical antenna coincides essentially with the axis of said reflector. A feeder line couples the antenna system with an external circuit, so that said primary helical antenna represents a backfire helical antenna coupled with said feeder line at the nearer end from said reflector and the other end of the helical antenna is free standing, and said feeder line is a coaxial cable.

It is further known from the international publication WO 92/13373 to use one or more helical feeders together with a dielectric lens. Thereby signals from several directions can be received simultaneously.

In the axial mode a helix wound like a right-hand screw receives right-hand circular polarization, while a helix wound like a left-hand screw receives left-hand polarization. This means known systems for the reception of different circular polarizations have two or more helices. For the reception of linear polarized radiation known systems use two or more helices wound in opposite directions. These helices can be provided side by side or can be connected in series.

Such a known antenna system for the reception of different polarizations is quite bulky. When such feeders are used together with concentration means, e.g. such as a parabolic reflector, a dielectric lens or the like, the helical antenna, or more precisely its phase center, must be coincident with the focal point of the concentration means, for each sens of polarization. Using two separate helices is sometimes inacceptable in a point of view of gain degradation and/or mutual coupling between the two opposite polarized helices due to inevitable defocussing and/or proximity.

It is an object of the present invention to provide a compact antenna system, for receiving several electromagnetical, preferably microwave, signals with different polarizations.

SUMMARY OF THE INVENTION

According to the invention the polarization, lefthand-circular, righthand-circular or linear, of a signal to be received can be changed by connecting an according end of a coil used as helical antenna to a feeder line.

When a first circular polarization, e.g. right-hand, is to be received the helix is working in axial endfire mode. For receiving the opposite circular polarization, the helix is connected such that it works in axial backfire mode.

This has the advantage that just one helix is used for an antenna system according to the invention. Thereby the phase centers of the two opposite circular polarizations can be very close to each other, ideally coincident, and the above mentioned problems of state of the art systems can be avoided.

DESCRIPTION OF THE DRAWINGS

Further characteristics, advantages and details of the invention will be explained in the followings embodiments with the aid of the drawing. Therein

DETAILED DESCRIPTION OF THE PREFERRED EMBODIMENT

Figure 1:
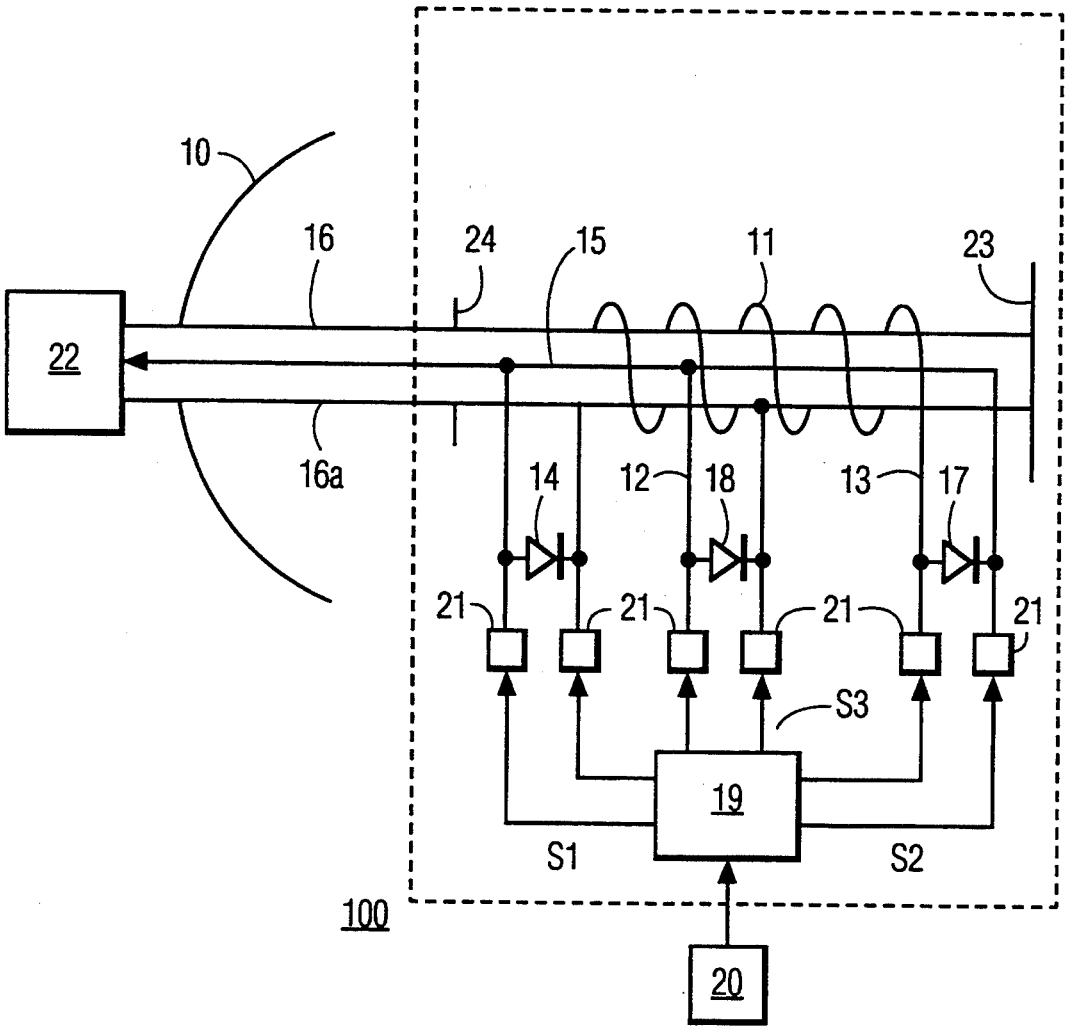
FIG. 1 shows a preferred embodiment.

In FIG. 1 a reflector 10, which can be shaped parabolically or thelike, focusses an incoming radiation (not shown) at its focal point. Along the axis of the reflector 10 and in the area of its focal point there is a helix 11 provided, which is built by a conductor wound in the shape of a coil with a helix-length of about is lambda, wherein lambda is the wavelength of the radiation to be received. The helix 11 has a first end 12, distance between it and the reflector 10 depends on f/D, wherein f is the focal length of the focussing system, here reflector 10, and D is the diameter of the said focussing system.

A second end 13 of the helix 11 is further away from the reflector 10 than the first end 12. The first end 12 of the helix 11 can be connected via a first switching device 14 with an inner conductor 15 of a feeder line 16. The second end 13 can be connected via a second switching device 17 with the inner conductor 15. A phase-shifter device 18 is provided to realise a connection between the inner conductor 15 and an outer conductor **16*a* of the feeder line 16 in the area of the middle of the helix 11**.

In this embodiment the switching devices 14 and 17 are realised as switching diodes. It may be mentioned that all other kinds off switches are possible, like relays, transistors, etc. The phase-shifter device 18 is realised in this embodiment by a transmission type as diode phaser. It may be mentioned that also any other kinds of phaser are possible.

The switching devices are controlled by means of control signals S1, S2 and the phase-shifting device is controlled by means of signal S3. These signals S1, S2, S3 are supplied by an electronic control unit 19, which gets according information from an input device 20. Between the control unit 19 and the devices 14, 17, 18 there are filters 21 provided which block the signals received by the helix 11 from the control unit 19.

The signals received by the helix 11 are led by the feeder line 16 to further electronic components, which are indicated by the block 22 and may include a low noise converter (LNC), mixers, oscillators, amplifiers and thelike and process information of said received signals such that according sound and/or pictures are generated.

At the end of the helix 11 there is a flat reflector 23 provided which is shaped as a disc with a diameter in the range of about $\lambda/2$ to $3\lambda/4$ half lambda to $\frac{3}{4}$ lambda.

A director 24 with a diameter of about third lambda is provided between the helix 11 and the parabolic reflector 10. The reflector 23 and the director 24 can e.g. also be shaped as a rectangular plate or thelike.

As indicated in FIG. 1 the helix 11 is wound right-hand. For the explanation of the function of the embodiment of FIG. 1 the following table 1 may be useful.

TABLE 1

| | switch 14 | switch 17 | phase shifter 18 |
|---|---|---|---|
| RHCP | off | on | — |
| LHCP | on | off | — |
| VLP | on | on | +90° |
| HLP | on | on | −90° |

with
RHCP : right-hand circular polarization
LHCP : left-hand circular polarization
VLP : vertical linear plarization
HLP : horizontal linear polarization Concerning the polarization to be received the following may be mentioned. The direction of circular polarization of a radiation to be received is inversed by each reflection, e.g. at the parabolic reflector 10. This means an odd number of reflections result in an opposite circular polarization and an even-number of reflections result in the original polarization sense.

For the reception of circular polarization, RHCP or LHCP respectively, the phase shift realised by the phase shifter 18 is not relevant. This means any phase shift state can be taken. For the reception of a circular polarization, only two discrete phase shift states, +90° and −90° respectively, are needed. These states are determined by the physical parameters of the phaser 18 and selectable by a control signal which could be a DC-voltage with according values.

The antenna system shown in FIG. 1 can be taken e.g. for the reception of television signals transmitted from a satellite. When a viewer wants to select TV-signals with a first circular polarization, he inputs according information via the input device 20 which gives an according signal to the control unit 19. This controls the devices 14, 17, 18 such that the switching device 14 is "on" and the switching device 17 is "off". Thereby the first end 12 of the helix 11 is connected with the inner conductor 15, the helix 11 is working in the axial backfire mode and a radiation with a first circular polarization, e.g. left-hand, is preferably received.

For the reception of the opposite circular polarization, e.g. right-hand, the switching device 14 is "off" and the switching device 17 is "on". Thereby the helix 11 works in the axial endfire mode and the right-hand circular polarization can be received.

For the reception of signals with linear polarization both switches 14, 17 are controlled in such a way that they are "on". Thereby the axial endfire mode and the backfire mode are simultaneously excited with equal amplitude. The combination of the two orthogonal circular polarizations result in a linear polarization radiated towards the reflector 10.

The direction of this resulting radiation is fixed by a phase difference between the two circular polarizations. This phase difference is controlled with the aid of the phase-shifter device 18, which is realised in this embodiment as a transmission diode.

Figure 2:
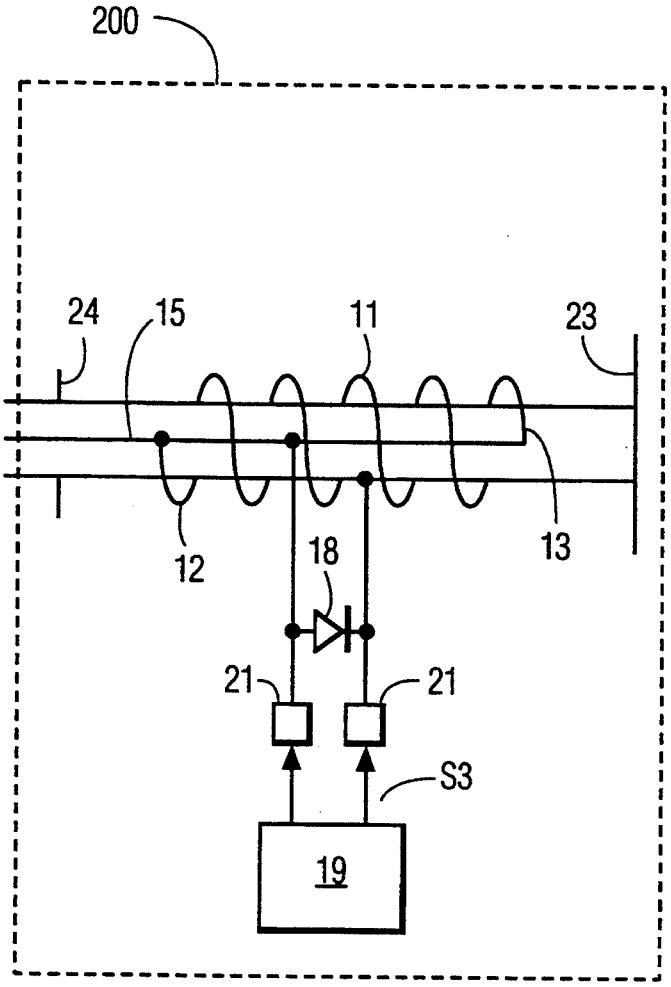
FIG. 2 shows an alternate embodiment of the antenna system of FIG. 1.
Figure 3:
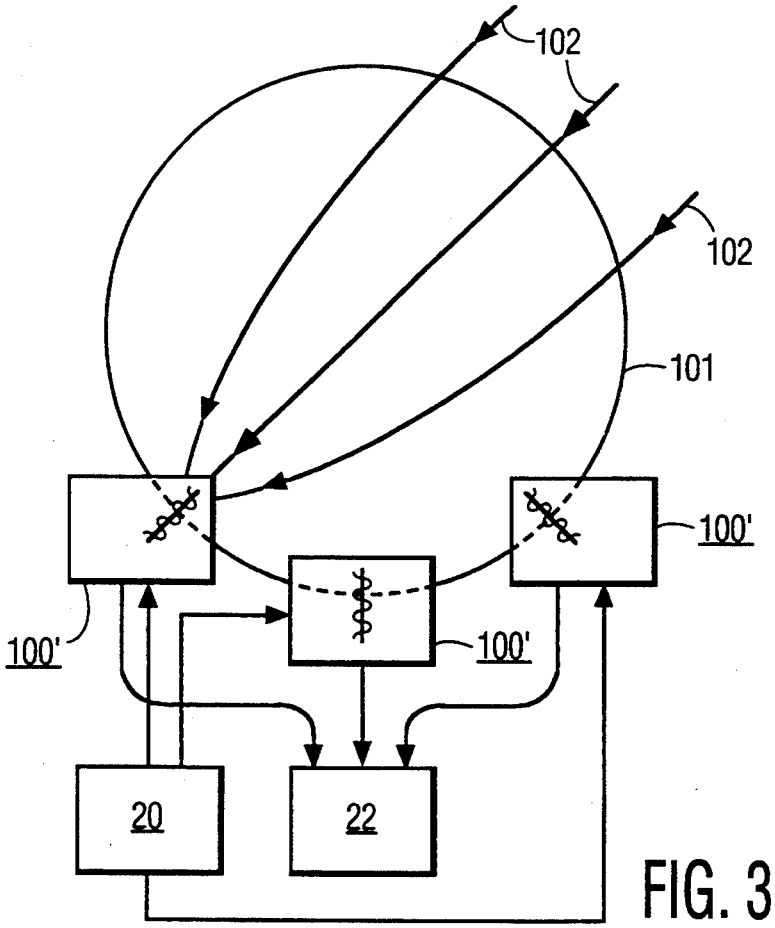
FIGS. 3 and 4 show helical feeders for the antenna systems of FIGS. 1 and 2.

Versions of the described embodiment may include at least one of the following variations:

- instead of the switches 14, 17 a fixed connection between the ends 12, 13 of the helix 11 and the inner conductor 15 may be provided, as can be seen in FIG. 2. Thereby it is possible to receive just the signals with linear polarization, like vertical (VLP) or horizontal (HLP);
- if just the reception of circular polarization is required, an antenna system without the phase-shifting device 18 can be realised;
- instead of using the parabolic reflector 10 other means for concentrating a radiation to be received can be taken. Such concentration can be achieved by diffraction, refraction and/or reflection. A preferred concentration means using refraction is a dielectric lens, which can be a spherical, as can be seen in FIG 3, or hemi-sperical, (see FIG. 4), Luneburg-type lens or thelike. In such cases one or more helices can be provided which are located in the area of the according focal point.

In FIG. 3 radiation 102 is focused by the Luneburg lens 101 in a focal point which is located near the position of an antenna block 100'. Accordingly, signals are coupled to block 22. Radiation from other directions (not shown) are focused near blocks 100', and accordingly, signals are also fed to block 22. The control of an antenna blocks is realized by the input device 20.

Figure 4:
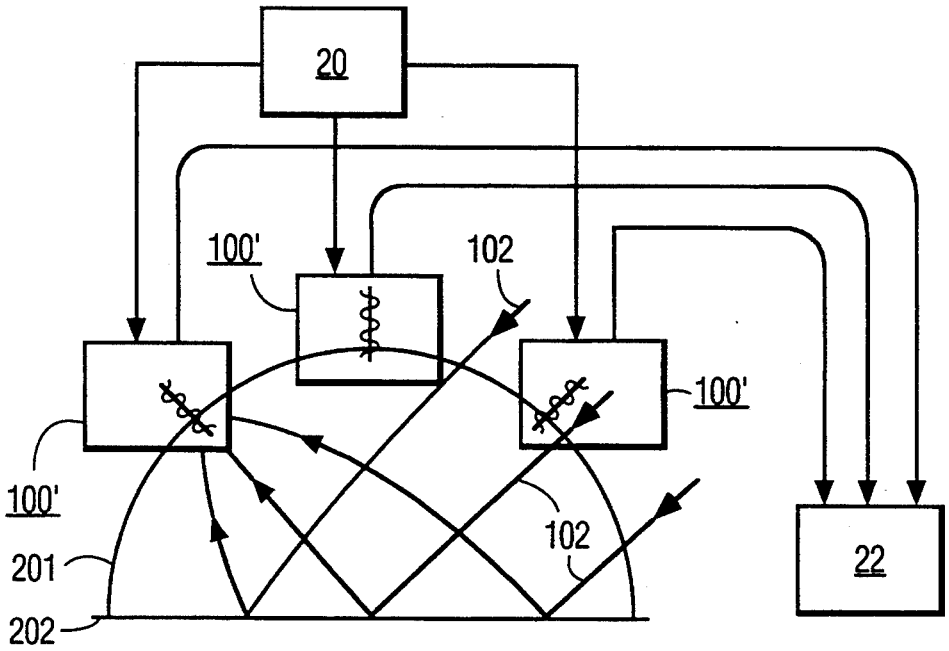

FIG. 4 shows an antenna system similar to the one of FIG. 3, but instead of a spherical Luneburg lens, a hemi-spherical Luneburg lens 201 is used having a plane reflector 202.

We claim:

1. An antenna system for receiving electromagnetic radiation from at least one direction and having at least one of right circular polarization, left circular polarizations, vertical linear polarization, and horizontal linear polarization, comprising:

means for concentrating energy at at least one focal point;

a helical antenna including at least one helical feeder, each feeder having first and second ends arranged in the proximity of said focal point;

a first switch for switching said first end to a feeder line;

a second switch for switching said second end to said feeder line; and control means for controlling said first and second switches in one of a first and second mode so that in the first mode said first switch switches said first end to said feeder line whereby said helical antenna works in an axial backfire mode and receives radiation with a first circular polarization, and in the second mode said second switch switches said second end to said feeder line whereby said helical antenna works in the axial endfire mode and receives radiation with a second circular polarization.

2. The antenna system of claim 1 wherein said first and second switches are simultaneously operated to put said helical antenna into a linear polarization mode of operation, and further including phase-shift means for selecting between horizontal and vertical linear polarization modes of operation.

3. The antenna of claim 1 wherein said first and second switches are diodes.

4. An antenna system for receiving electromagnetic radiation from at least one direction and having at least one of right circular polarization, left circular polarization, vertical linear polarization, and horizontal linear polarization, comprising:

a first group of at least one helical feeder, each helical feeder having a first end and a second end with both ends of said feeder being connected by a fixed connection to a feeder line, each helical feeder having means for concentrating energy at at least one focal point;

phase-shifting means;

first control means for controlling said, phase-shifting means to select between said vertical and horizontal linear polarization modes of operation;

a second group of at least one helical feeder each helical feeder having a first end and a second end;

a first switch for switching said first end of each helical feeder of the second group to a feeder line;

a second switch for switching said second end of each helical feeder of the second group to said feeder line; and second control means for controlling said first and second switches in one of a first and second mode so that in the first mode said first switch switches said first end to said feeder line whereby said helical antenna works in the axial backfire mode and receives radiation with a first circular polarization, and in the second mode said second switch switches said second end to said feeder line whereby said helical antenna works in the axial endfire mode and receives radiation with a second circular polarization.

* * * * *